US005881390A

United States Patent [19]

Young

[11] Patent Number: 5,881,390

[45] **Date of Patent: *Mar. 16, 1999**

[54] HEADBAND FOR USE WITH PERSONAL STEREO HEADPHONES

[75] Inventor: Bradley Brent Young, Boulder, Colo.

[73] Assignee: Outdoor Dynamics, Incorporated, Boulder, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 725,355

[22] Filed: Oct. 3, 1996

[51] Int. Cl.[6] ..... A42B 3/30

[52] U.S. Cl. ..... 2/209.13; 2/209.3; 381/187

[58] Field of Search ..... 2/209.13, 209, 2/171, 181, 209.3, 207; 381/25, 183, 187; 379/430; 455/351

[56] References Cited

U.S. PATENT DOCUMENTS

| | | | |
|---|---|---|---|
| 2,474,386 | 6/1949 | Volkmann . | |
| 4,520,510 | 6/1985 | Daigle | 2/207 X |
| 4,521,922 | 6/1985 | Mitchell et al. | 2/171 |
| 4,538,034 | 8/1985 | French | 179/182 |
| 4,776,044 | 10/1988 | Makins | 381/187 X |
| 4,858,248 | 8/1989 | Goldsmith et al. | 2/209.1 |
| 4,864,619 | 9/1989 | Spates | 381/187 X |
| 4,991,222 | 2/1991 | Nixdorf | 381/187 X |
| 5,146,501 | 9/1992 | Spector | 381/25 |
| 5,164,987 | 11/1992 | Raven | 381/25 |
| 5,257,420 | 11/1993 | Byrne, Jr. | 2/209 |
| 5,264,165 | 11/1993 | Rauch | 381/187 X |
| 5,265,165 | 11/1993 | Rauch | 381/25 |
| 5,303,426 | 4/1994 | Jones | 2/209.13 X |
| 5,329,592 | 7/1994 | Altman | 381/25 |
| 5,594,956 | 1/1997 | Barrientos | 2/172 X |

*Primary Examiner*—Peter Nerbun
*Attorney, Agent, or Firm*—Macheledt Bales & Johnson LLP; Jennifer L. Bales

[57] ABSTRACT

A flexible headband for use with personal stereo headphones allows easy adjustment of the headphone speaker position. The headband is formed of a continuous tube of a stretchable material which has a buttonhole opening in the back toward the inside. The speakers are inserted into the buttonhole and worked around either side of the tube until they are located over the user's ears. The stretchable material stretches primarily laterally, squeezing the speakers firmly in place when the headband is worn. The headband may be attached to a hat or a bandanna.

8 Claims, 1 Drawing Sheet

HEADBAND FOR USE WITH PERSONAL STEREO HEADPHONES

BACKGROUND OF THE INVENTION

1. Field of the Invention

The present invention relates to a headband for use with personal stereo headphones.

2. Description of the Related Art

Personal stereos are popular with joggers and others who wish to listen to tapes or the radio while enjoying sports, working outside or performing other activities. Conventional personal stereos come with a headset comprising small headphone speakers attached to a metal or plastic band which fits over the user's head. The headphone speakers are rigid and uncomfortable on the user's ears, and the headset is either too tight or shakes off when the user moves suddenly. If it is cold, the user must either wear a hat or a headband over the headset, jamming the rigid headphone speakers against the user's ears, or wear the headset over the top of the hat or headband, which means the user's ears cannot be covered by the hat or headband.

The conventional headsets are so uncomfortable and hard to adjust that attempts have been made to attach speaker elements to visors, eyeglasses, earmuffs or headbands. U.S. Pat. No. 4,864,619 teaches attaching speaker elements to a flexible headband structure with Velcro. U.S. Pat. No. 5,257,420 teaches inserting the headset into a pair of earmuffs. U.S. Pat. No. 5,265,165 teaches placing speaker elements into pockets on a visor. U.S. Pat. No. 5,164,987 teaches attaching speaker elements to flaps which slide over the ear pieces of eyeglasses.

A need remains in the art for a comfortable flexible headband or hat for use with personal stereo headphone speakers which is comfortable and allows easy adjustment of the speaker position.

SUMMARY OF THE INVENTION

An object of the present invention is to provide a comfortable flexible headband for use with personal stereo headphone speakers which is comfortable and allows easy adjustment of the speaker position.

A headband for use with personal stereo headphones having speaker elements attached to wires leading to a personal stereo is described herein. The headband comprises an elongated tube of stretchy material, the tube forming a circular band cap able of circumscribing a users head, and forming a buttonhole opening for permitting insertion of the speaker elements. Generally, the tube is continuous, and only one buttonhole is provided. As a feature, the stretchy material stretches only in the lateral direction, to elongate the tube and squeeze or pinch the speakers, holding them in place.

A hat may be attached to the headband so that when the hat is worn, the headband circumscribes a wearers head. Or, a bandanna may be attached to the headband.

The stretchy material might be Polar fleece, lycra, Cool Max (TM), chamois, terry cloth, or the like.

DETAILED DESCRIPTION OF THE PREFERRED EMBODIMENT

Figure 1:
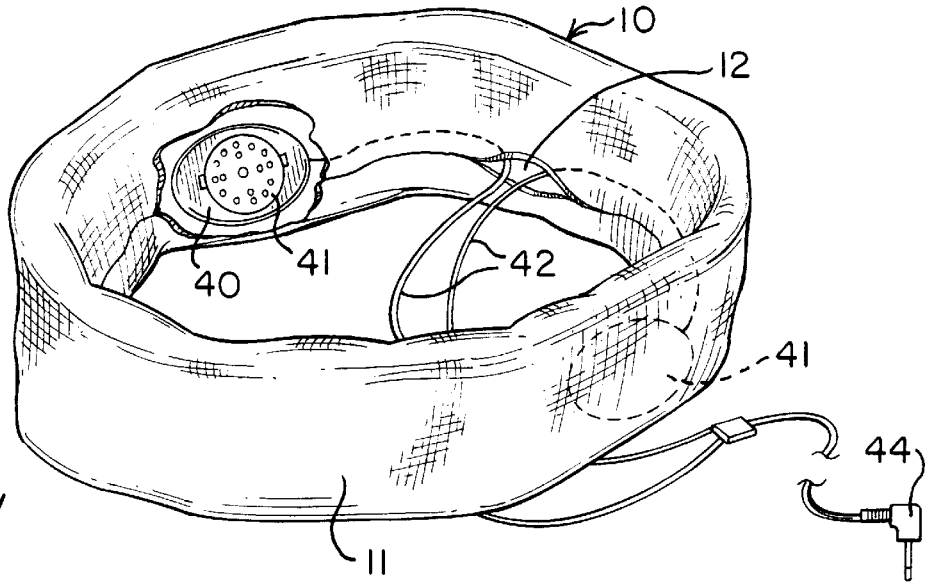
FIG. 1 shows an isometric cutaway view of a headband for use with personal stereo headphone speakers in accordance with the present invention.

FIG. 1 shows an isometric cutaway view of a headband 10 for use with personal stereo headphones 40 in accordance with the present invention. In the preferred embodiment, headband 10 comprises a continuous tube 11 of a flexible stretchy material. Tube 11 is formed with a buttonhole opening 12. For example, a sheet of the stretchy material might be sewn into a tube by folding it over and sewing a seam along the folded edges. Then, buttonhole 12 would be formed by leaving a small area of the edges unsewn to form a horizontal buttonhole, as shown. Alternatively, a headband 10 may be knitted in the shape of a tube. In any case, the ends of the tube are then sewn together around the edges, but preferably not through the tube; i.e., the tube is continuous such that an item inserted into buttonhole 12 can be worked all the way around the tube and back to buttonhole 12. In the case of the knitted tube, buttonhole 12 may be cut into tube 11, or may be formed by leaving a small area of the tube edges unsewn, thereby forming a vertical buttonhole.

Headphones 40 are conventional and generally comprise speaker elements 41 connected to wires 42 leading to a connector 44 which connects to a personal stereo (not shown). For example, Awia (TM) speakers might be used. In use, speaker elements 41 are inserted into buttonhole 12, and worked around either side of tube 11 to approximately the location of the user's ears when headband 10 is worn. Wires 42 run out the back of headband 10 through buttonhole 12. The user dons headband 10, then adjusts speaker elements 41 over the user's ears. Since the fabric forming tube 11 is stretchy, it holds speaker elements 41 firmly in place over the user's ears. In the preferred embodiment, the fabric forming tube 11 stretches primarily in only one direction, laterally, so that tube 11 elongates. The advantage to having the fabric stretch in only one direction is that as tube 11 elongates, it becomes smaller in diameter, thereby squeezing or pinching speaker elements 41 firmly in place. An example of such a fabric is Polartek (TM) fleece.

Generally, the user will wear headband 10 with buttonhole 12 in the back and toward the inside. In this way, headband 10 presents a fashionable look, with headphones 40 not being very noticeable. Speakers 41 may be easily removed through buttonhole 12, to allow tube 11 to be washed. Headband 10 may be worn without speakers 41 in place, if desired. Headband 10 may be sold with speaker elements 11, or separately.

Figure 2:
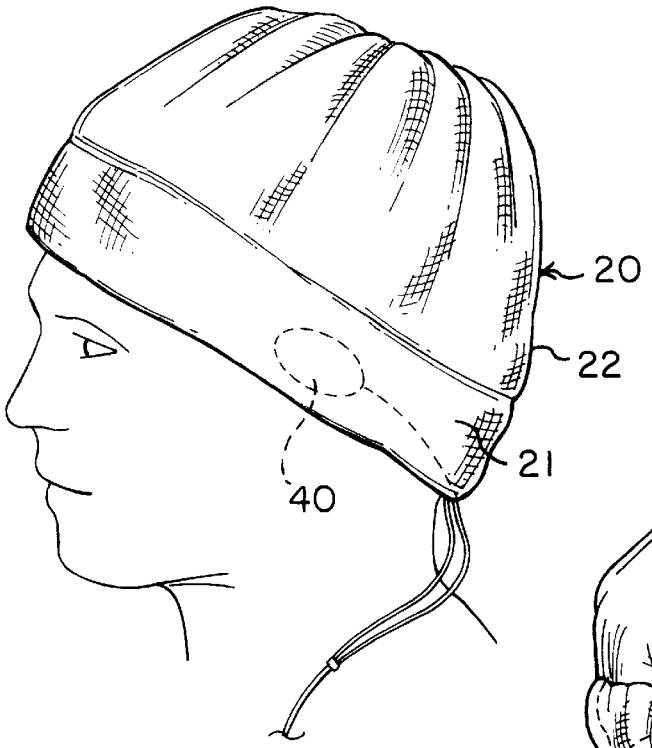
FIG. 2 shows an isometric view of a hat incorporating the headband of FIG. 1.

FIG. 2 shows an isometric view of a hat 20 incorporating a headband 21 according to the present invention, and a hat top portion 22. Headband 21 is similar to headband 10 shown in FIG. 1. Hat top portion 22 is attached to headband 21, for example by being sewn to the top of headband 21 as shown in FIG. 2. Alternatively, headband 21 may be, attached to the inside of the bottom portion of hat 20, or hat 20 may be folded up around headband 21. In the preferred embodiment, hat top 22 is formed of material matching, or contrasting, with the material forming headband 21, and headband 21 is sewn to the bottom of hat top 22, so that hat 20 simply appears to be a conventional hat. As in the case of headband 10 of FIG. 1, headband 21 is generally positioned with the buttonhole (not shown) in the back and toward the inside.

Figure 3:
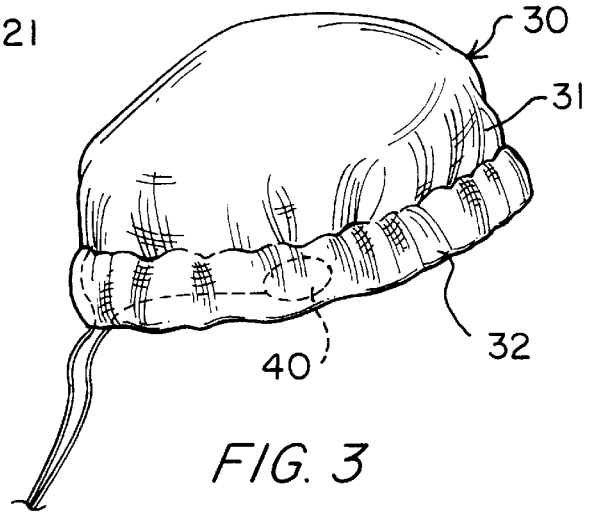
FIG. 3 shows an isometric view of a bandanna incorporating the headband of FIG. 1.

FIG. 3 shows an isometric view of a bandanna-type headgear 30 incorporating a headband 32 and a bandanna

31. Headband 32 is similar to headband 10 of FIG. 1. Bandanna 31 is attached to headband 32, for example, by having one edge of bandanna 31 sewn along four to six inches of the bottom edge of headband 32. Headgear 30 may be worn in a number of ways. In the configuration shown in FIG. 3, bandanna 31 has been wrapped once around the entire periphery of headband 32, except the small area adjacent to the buttonhole (not shown). Then, bandanna 31 is passed over the user's head, and tucked into headband 32 around the head, to form the appearance of a headrag (or "do-rag"). Alternatively, bandanna 31 may be wrapped around headband 32 several times and tied, to form the appearance of a plain bandanna headband for absorbing sweat. Preferably, headband 32 is formed of a lighter summer weight material such as lycra, Cool Max (TM), chamois, or terry cloth.

While the exemplary preferred embodiments of the present invention have been described in detail, those skilled in the art will recognize various changes, modifications, additions, and applications other than those specifically mentioned herein which fall within the spirit of this invention.

What is claimed is:

1. A headband in combination with attached headphones comprising:

a pair of speaker elements attached to wires for connection to a personal stereo;

an elongated tube of flexible fabric forming a circular headband body for circumscribing a user's head, the tube having solely a single buttonhole opening of a size enabling insertion of the speaker elements through the buttonhole into the tube and being formed of a material stretchable primarily only in a single direction corresponding to the length of the tube;

said tube having an interior cross-sectional dimension in an unstretched condition enabling substantial free movement of the speaker elements from the buttonhole along opposite sides of the headband to body locations in substantial respective registration with a user's ears, with the wires trailing through the tube and exiting the headband through the buttonhole, said tube of fabric material being stretched in said single direction when in place about the user's head to reduce a cross-sectional diameter of the tube and squeeze the material of the tube about each speaker element to maintain the speaker elements firmly in place relative to the tube and in registration with a user's ears.

2. The headband of claim 1 wherein the tube is continuous.

3. The headband of claim 1, further including a hat attached to the tube so that when the hat is worn the tube circumscribes a wearers head.

4. The headband of claim 1, further including a bandanna attached to the tube.

5. The headband of claim 1 wherein the stretchable material is fleece.

6. The headband of claim 1 wherein the stretchable material is spandex.

7. The headband of claim 1 wherein the stretchy material is a lightweight, sweat wicking material.

8. The headband of claim 1 wherein the stretchable material is chamois.

* * * * *